United States Patent [19]

Smith, Jr.

[11] Patent Number: 4,722,390

[45] Date of Patent: Feb. 2, 1988

[54] ADJUSTABLE COLLET

[75] Inventor: Sidney K. Smith, Jr., Huntsville, Tex.

[73] Assignee: Hughes Tool Company, Houston, Tex.

[21] Appl. No.: 944,276

[22] Filed: Dec. 18, 1986

[51] Int. Cl.[4] ..... E21B 23/02; E21B 31/12

[52] U.S. Cl. ..... 166/115; 166/123; 166/181; 166/208; 294/86.25

[58] Field of Search ..... 166/115, 123, 124, 125, 166/136, 181, 208, 211, 214, 217; 294/86.24, 86.25, 86.32, 93, 94

[56] References Cited

U.S. PATENT DOCUMENTS

| | | | |
|---|---|---|---|
| Re. 31,607 | 6/1984 | Vogel et al. | 166/214 |
| 3,104,708 | 9/1963 | Orr et al. | 166/46 |
| 3,574,385 | 4/1971 | Pignataro, Jr. | 294/86.25 |
| 3,638,988 | 2/1972 | Brown | 294/86.25 |
| 3,698,756 | 10/1972 | Groves | 294/86.25 |
| 4,449,736 | 5/1984 | Blackwell | 166/115 |
| 4,477,104 | 10/1984 | Akkerman | 166/124 |
| 4,513,822 | 4/1985 | Gilbert | 166/382 |
| 4,655,290 | 4/1987 | Smith, Jr. | 166/217 |

*Primary Examiner*—Stephen J. Novosad
*Assistant Examiner*—Terry Lee Melius
*Attorney, Agent, or Firm*—Charles D. Gunter, Jr.

[57] ABSTRACT

An adjustable collet is shown which includes a collet body having an internal bore and integral collet arms. An adjustment ring is received within the bore of the collet body and has a depending portion which engages the collet arms. By adjusting the position of the ring within the collet body bore and varying the longitudinal position of the depending portion relative to the collet arms, the effective collet arm length can be varied.

5 Claims, 4 Drawing Figures

ADJUSTABLE COLLET

BACKGROUND OF THE INVENTION

1. Field of the Invention

The present invention relates to collets of the type having a collet body and a plurality of depending collet arms which flex inwardly and outwardly and to such collets having an adjustment feature for varying the effective collet arm length.

2. Description of the Prior Art

Collets are used in a variety of mechanical structures, including oil well tools and equipment. The collet has a metal ring shaped body and a plurality of integral collet arms depending therefrom. The collet arms flex radially inward and outward with respect to a longitudinal axis drawn through the center of the bore of the collet body. U.S. Pat. No. 4,513,822 to Gilbert, issued Apr. 30, 1985, and entitled "Anchor Seal Assembly", shows a seal assembly of the type used to anchor tubing within the bore of a surrounding conduit. A threaded collet circumscribes a portion of the exterior of the tubing and is stabbed into a mating profile within the bore of the surrounding conduit for latching the tubing within the surrounding conduit. In this and similar applications, it is often an advantage to be able to easily adjust the effective collet arm length to thereby increase or decrease the loading of the collet. That is, a longer relative collet arm length is more flexible and can handle stresses more easily without bending of the collet arms. A short relative collet arm length provides greater loading strength.

It is an object of the present invention to provide a collet with an adjustment feature for easily varying the effective collet arm length.

SUMMARY OF THE INVENTION

The adjustable collet of the invention includes a collet body having an internal bore and a plurality of integral collet arms. An adjustment ring is received within the internal bore of the collet body. The adjustment ring has a depending portion which is adapted to engage collet arms. Connecting means are provided for engaging the adjustment ring within the collet body bore and for varying the longitudinal position of the adjustment ring relative to the collet arms, whereby the position of the adjustment ring relative to the collet body changes the effective collet arm length. Preferably, the adjustment ring is externally threaded and is engaged on a mating internally threaded surface of the collet body. In this way, screw threaded adjustment of the adjustment ring relative to the collet body changes the effective collet arm length.

Additional objects, features and advantages will be apparent in the written description which follows.

FIG. *3a* is a side, cross-sectional view of an oil well seal assembly featuring the adjustable collet of the invention received within a surrounding well conduit.

FIG. *3b* is a downward continuation of the device of FIG. *3a*.

DETAILED DESCRIPTION OF THE INVENTION

Figure 1:
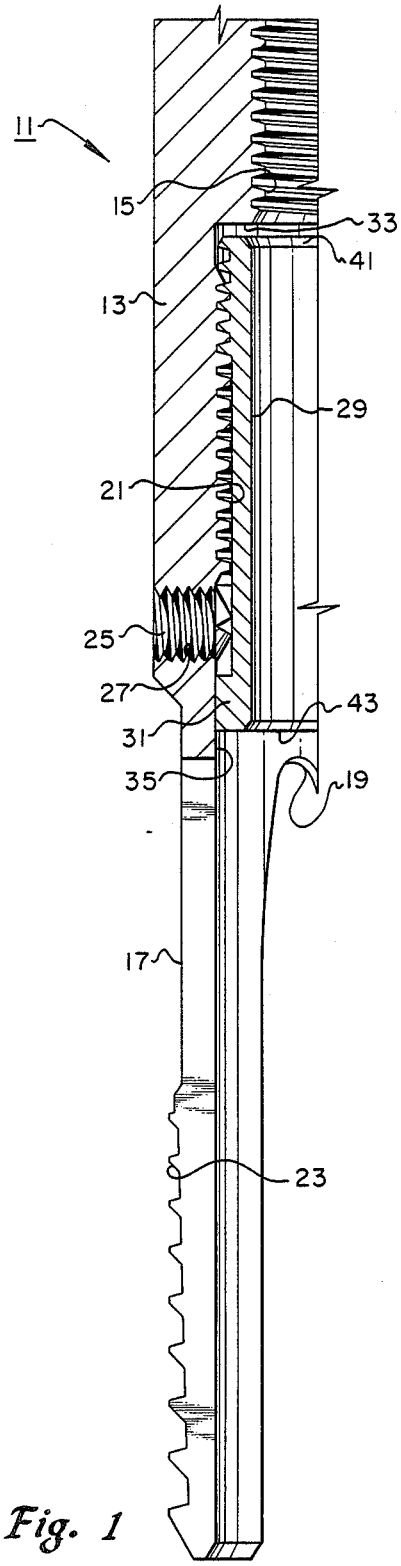
FIG. 1 is a partial, cross-sectional view of an adjustable collet of the invention showing the adjustment ring in the uppermost position to give the maximum effective collet arm length.

FIG. 1 shows an adjustable collet of the invention designated generally as 11. The collet 11 includes a metal ring or body 13 which has an upper internally threaded bore 15 and a plurality of integral collet arms 17 which depend downwardly from the body 13. Each of the collet arms 17 is spaced apart from the next adjacent arm by a longitudinal opening 19. In the embodiment shown, the collet 11 is preferably provided with six collet arms 17 evenly spaced apart in circumferential fashion by openings 19. The upper bore 15 of the collet 11 widens in internal diameter to form a lower threaded bore 21. In the example of FIG. 1, the collet arms 17 are also externally threaded to form a thread profile 23 for latching engagement with a circumscribing conduit, as will be explained. The collet body 13 has at least one set screw 25 which is located within a bore 27 which passes radially through the collet body into the internal bore 21.

An externally threaded adjustment ring 29 is engaged on the internally threaded surface 21 of the collet body 13. The adjustment ring 29 is generally cylindrically shape and widens in external diameter at the lower extent thereof to form a collar portion 31. Externally threaded surface 39 matingly engages the internally threaded surface 21 up the collet body. In the position shown in FIG. 1, the upper extent of the adjustment ring 29 abuts an internal shoulder 33 formed by the junction of the bores 15, 21. The collar portion 31 of the adjustment ring 29 circumscribes the interior surface 35 of each of the collet arms and thereby engages the collet arms 17 at a point of contact.

Figure 2:
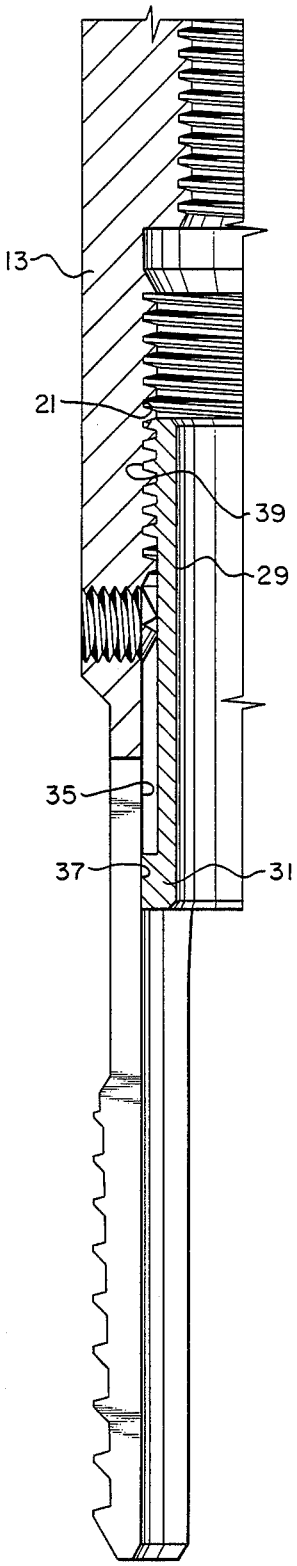
FIG. 2 is a view similar to FIG. 1 showing the adjustment ring moved downwardly to shorten the effective collet arm length.

As shown in FIG. 2, screw threaded adjustment of the adjustment ring 29 relative to the collet body 13 varies the point of contact between the ring depending portion 31 and the interior surface 35 of the collet arms to thereby vary the effective collet arm length. The longitudinal position of the adjustment ring 29 can be varied by causing the ring externally threaded surface to travel along the lower threaded internal bore 21 of the collet body. This can be accomplished by any convenient means. For instance, the internal surface of the adjustment ring 29 can be provided with a profile for engaging an adjustment tool, or the lips 41, 43 of the ring can be provided with notches or the like for engaging an adjustment wrench. By whatever means, the adjustment ring position can be varied by causing the threaded surface 39 to travel along the collet threaded surface 21 to vary the effective collet arm length. Thus, the retracted position of the adjustment ring shown in FIG. 1 provides the maximum effective collet arm length and therefore the greatest flexibility and ability to handle stress. In the fully retracted position shown in FIG. 1, the adjustment ring lip 43 is received entirely within the bore of the collet body and does not extend past the origin of the opening 19. An intermediate, extended position of the adjustment ring 29, as shown in FIG. 2, shortens the effective collet arm length and enables the collet to bear a heavier load.

Figure 3A:
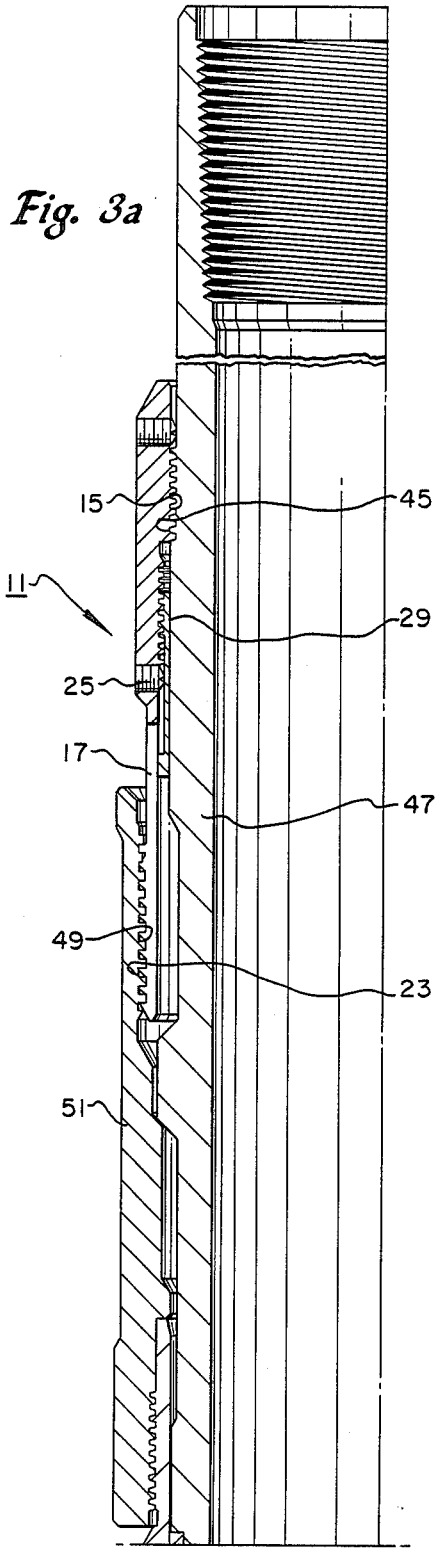
Figure 3B:
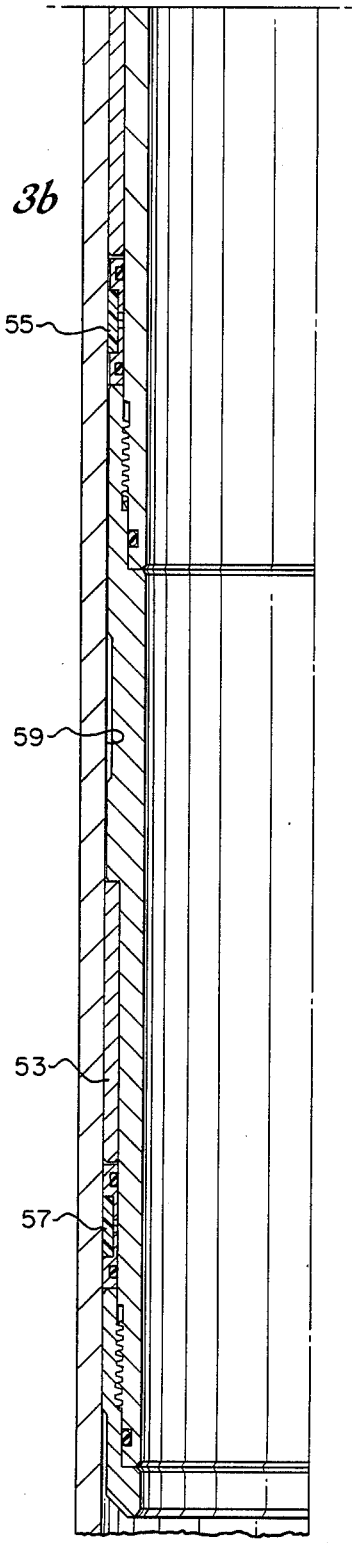

FIGS. *3a* and FIG. *3b* show a typical application of the adjustable collet 11 of the invention. In FIG. *3a*, the threaded bore 15 of the collet is engaged on a mating externally threaded surface 45 of tubing member 47. The collet arm external thread profile 23 has been stabbed in and latched into engagement with a mating profile 49 of a circumscribing conduit 51. A seal ring 53 of a suitable elastomer and upper and lower packings 55, 57 are carried about the exterior of the tubing member 47 for sealing within the bore 59 of the circumscribing conduit 51. By providing a longer effective collet arm length, the collet arms 17 can be more easily ratcheted into engagement with the profile 49. By shortening the effectie collet arm length, a greater load can be carried by the latch assembly. As shown in FIG. 3*a*, the adjustment ring 29 has been located at an intermediate position to optimize the features of flexibility and load bearing strength.

While the invention has been shown in only one of its forms, it is not thus limited but is susceptible to various changes and modifications without departing from the spirit thereof.

I claim:

1. An adjustable collet, comprising:

a collet body having a cylindrical internal bore and a plurality of integral collet arms depending from the collet body, each of the collet arms having an exterior surface and an interior surface;

an adjustment ring received within the internal bore of the collet body, the adjustment ring being movable between a retracted position entirely within the bore of the collet body and an extended position, the adjustment ring having a depending portion which engages the interior surface of the collet arms at a point of contact when the ring is moved to the extended postion; and connecting means for engaging the adjustment ring within the collet body bore and for varying the longitudinal position of the adjustment ring relative to the collet arms, whereby varying the position of the adjustment ring relative to the collet body varies the point of contact between the ring depending portion and the interior surface of the collet arms to thereby vary the effective collet arm length.

2. An adjustable collet, comprising:

a cylindrical body having an internally threaded, cylindrical surface and a plurality of collet arms integral with the collet body and extending therefrom, each of the collet arms having an exterior surface and an interior surface;

an externally threaded adjustment ring engaged on the internally threaded surface of the collet body, the adjustment ring being movable between a retracted position and an extended position, the adjustment ring having a depending collar portion which circumscribes the collet body internal bore in the retracted position and which circumscribes the interior surface of the collet arms and engages the collet arms at a point of contact in the extended position so that screw threaded adjustment of the adjustment ring relative to the collet body varies the point of contact between the ring depending portion and the interior surface of the collet arms to thereby vary the effective collet arm length.

3. The adjustable collet of claim 2, wherein the adjustment ring has a cylindrical threaded extent of lesser relative external diameter for engaging the internally threaded surface of the collet body, and wherein the collar portion is of greater relative external diameter and forms an external shoulder with the cylindrical threaded extent.

4. The adjustable collet of claim 3, wherein the collet body has at least one set screw located within a set screw bore which passes radially through the collet body in the direction of the adjustment ring for securing the adjustment ring at one selected longitudinal position within the collet body.

5. The adjustable collet of claim 4, wherein the collet arms are externally threaded for engaging the mating threaded profile of a surrounding conduit.

* * * * *